US005410992A

United States Patent [19]

Hunt et al.

[11] Patent Number: 5,410,992

[45] Date of Patent: May 2, 1995

[54] COOLING SYSTEM FOR AUTOMOTIVE ENGINE

[75] Inventors: Charles S. Hunt, Plymouth; Robert W. Kay, Belleville; David T. Patrick, Dearborn; Robert L. Schmidt, Farmington Hills; Ajit R. Shembekar, Dearborn, all of Mich.

[73] Assignee: Ford Motor Company, Dearborn, Mich.

[21] Appl. No.: 222,055

[22] Filed: Apr. 4, 1994

[51] Int. Cl.[6] ..... F01P 7/10

[52] U.S. Cl. ..... 123/41.49; 180/68.1; 415/208.1; 416/169 A

[58] Field of Search ..... 123/41.49; 180/68.1; 415/208.1, 211.1; 416/169 A

[56] References Cited

U.S. PATENT DOCUMENTS

| | | | |
|---|---|---|---|
| 3,144,859 | 8/1964 | Walton | 123/41.49 |
| 4,018,297 | 4/1977 | Haupt | 123/41.49 |
| 4,194,556 | 3/1980 | Watanabe et al. | 123/41.49 |
| 4,353,680 | 10/1982 | Hiraoka et al. | 415/219 R |
| 4,662,822 | 5/1987 | Foeldesi et al. | 123/41.49 |
| 4,774,911 | 10/1988 | Yamaguchi et al. | 123/41.49 |
| 5,183,382 | 2/1993 | Carroll | 123/41.49 |

*Primary Examiner*—Noah P. Kamen

*Attorney, Agent, or Firm*—Jerome R. Drouillard; Roger L. May

[57] ABSTRACT

A variable geometry fan duct for an automotive engine cooling system having a fan-cooled, liquid-to-air radiator includes a support structure for securing the fan duct to the radiator and fixed and movable barrel segments which are arranged such that the movable barrel segment may be moved from a first position in which the movable segment is nested with the fixed segment to a second position in which the segments completely encircle and shroud the fan blade.

6 Claims, 2 Drawing Sheets

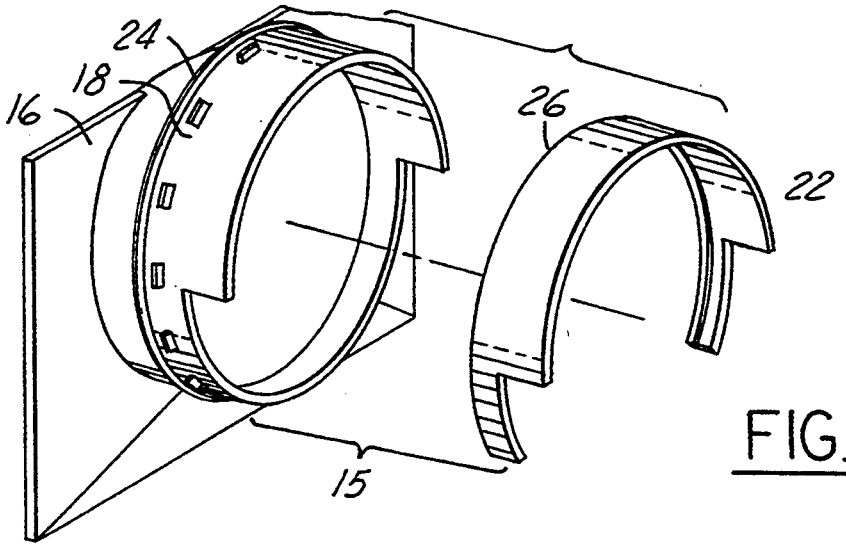
FIG. 4
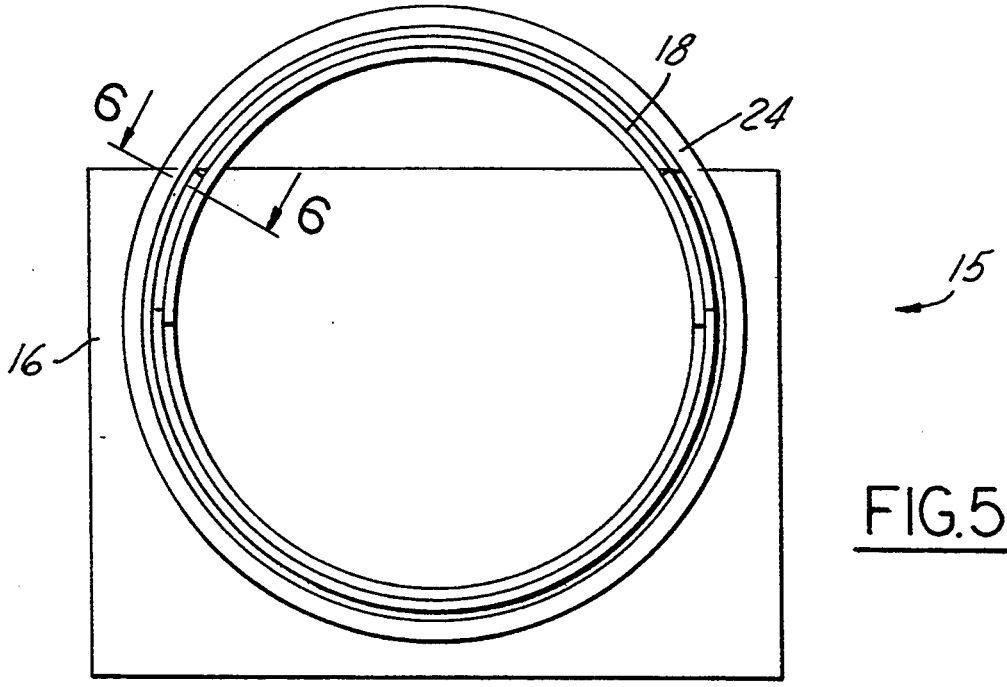
FIG. 5
FIG. 6
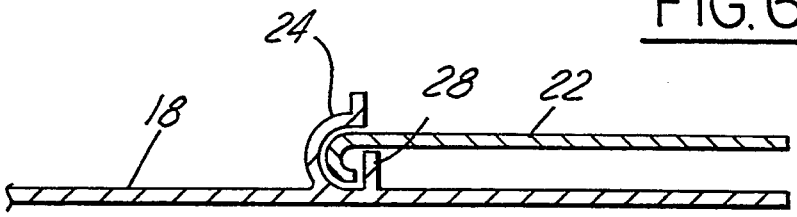

COOLING SYSTEM FOR AUTOMOTIVE ENGINE

BACKGROUND OF THE INVENTION

The present invention relates to an automotive engine cooling system having an engine driven fan and a variable geometry fan duct for pulling air through a liquid-to-air radiator.

DISCLOSURE INFORMATION

It is well known that the efficiency of axial flow fans commonly employed in automotive engine cooling systems to draw air through the core of a liquid-to-air heat exchanger (commonly termed a "radiator") will be markably improved if the clearances between the fan blade tips and the fan duct or shroud are minimized. It is therefore desirable to maintain the cooling fan within a closely fitted fan shroud or duct. Such a duct should be rigid so as to avoid both unwanted noise excited by engine vibration as well as to prevent unwanted contacts between the fan blades and the fan duct or shroud. Accordingly, a variety of rigid shrouds have been invented and examples of such are shown in U.S. Pat. No. 3,144,859 to Walton, U.S. Pat. No. 4,194,556 to Watanabe et al., and U.S. Pat. No. 5,183,382 to Carroll. Each of these designs suffers from the drawback, however, that it is necessary that the fan and shroud assembly be engaged axially during the assembly of the vehicle. In other words, it is not possible generally to engage the shroud with the fan by moving the shroud radially into proximity with the fan blades because the shroud and blades would strike one another. U.S. Pat. No. 4,018,297 to Haupt discloses a multi-piece fan shroud in which various sections may be removed by unbolting so as to permit assembly of the shroud about the fan. This, however, necessitates additional parts, cost, and assembly labor time, all of which render the device more expensive than a system according to the present invention. A cooling system for an automotive engine having a variable geometry duct according to the present invention may be assembled about the fan and placed in contact with the radiator after both the fan and the radiator have been installed in the vehicle, and without using tools because of the present variable geometry, which allows the barrel portion of the shroud to be temporarily placed in an open position.

SUMMARY OF THE INVENTION

A variable geometry fan duct for an automotive engine cooling system having a fan-cooled liquid-to-air radiator comprises a support structure for securing the fan duct to the radiator, a fixed barrel segment attached to the support structure, and a movable barrel segment attached to the fixed segment such that the movable segment is rotatable from a first position in which it is nested upon the first segment to a second position in which the segments completely encircle and shroud the blade tips of an axial flow cooling fan. The cooling fan may be either electrically or engine driven, and it is readily seen that a system according to the present invention is particularly adapted to the use of engine driven fans, which are typically bolted either to the engine's water pump, or to a special bearing in sturdy fashion in such a manner so as not to be readily displaceable. In essence, the shroud includes fixed and movable barrel segments with the movable segment being rotatable from a first, or shipping, position in which it is nested upon the fixed segment, to a second, or installed, position in which the segments encircle and shroud the fan blade tips. The movable barrel segment comprises a partial cylinder having a flange engaged with a mating slot formed on the fixed barrel such that the flange may slide within the slot as the movable barrel segment rotates with respect to the fixed barrel segment.

According to yet another aspect of the present invention, a method for installing a variable geometry radiator fan duct in a vehicle having an internal combustion engine and an engine driven fan for moving air through a liquid-to-air engine cooling radiator includes the steps of: placing the fan duct in an open configuration suitable for moving the duct into a position partially encircling the fan; installing the duct upon a radiator while the duct is in the open configuration; and placing the duct into a closed configuration in which the duct forms a barrel which completely encircles and shrouds the blade tips of the fan. As described before, the duct is placed in a closed configuration by rotating the movable barrel segment with respect to a fixed barrel segment until the segments form a complete ring around the fan blades.

BRIEF DESCRIPTION F THE DRAWINGS

FIG. 4 is an exploded perspective showing the major component parts of a fan duct according to the present invention.

FIG. 5 is an end view of a fan duct as illustrated in FIG. 4.

FIG. 6 is a cross-section of a portion of the duct of FIG. 5 taken along the line 6—6 of FIG. 5.

DETAILED DESCRIPTION OF THE PREFERRED EMBODIMENTS

Figure 1:
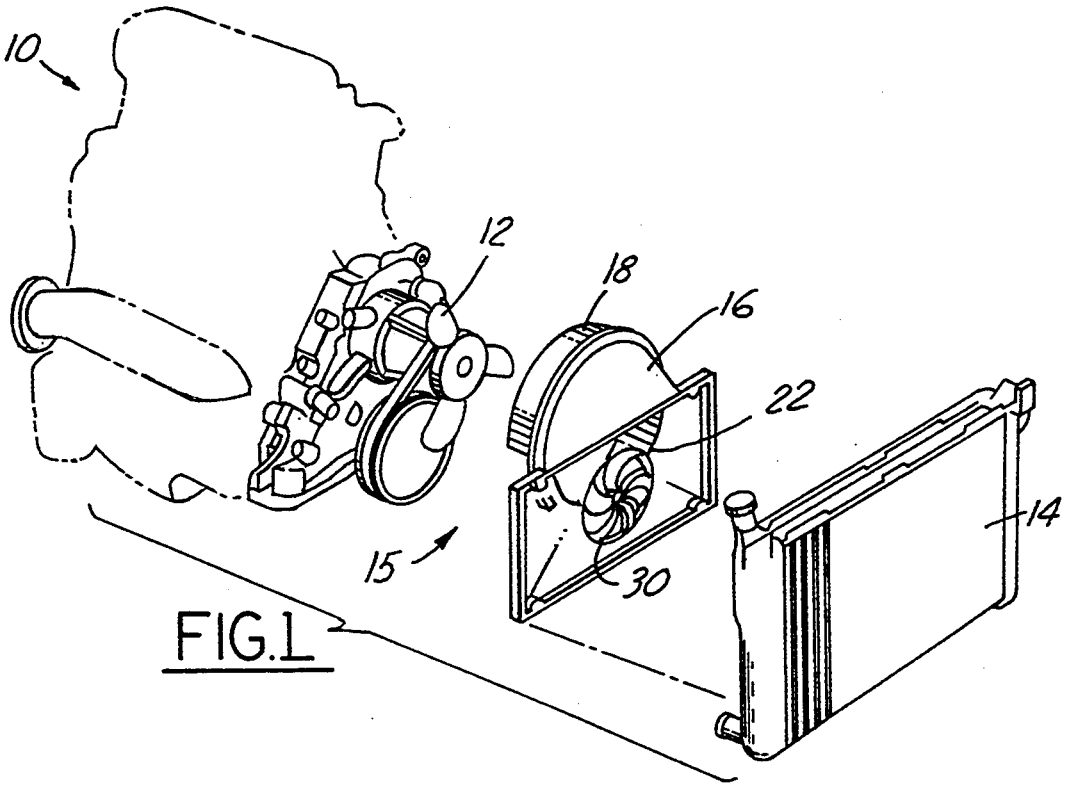
FIG. 1 is an exploded perspective of an engine and cooling system according to the present invention.

FIG. 1 illustrates an automotive engine 10 having an engine driven fan 12 which pulls air through radiator 14. Fan duct 15, which includes support structure 16, and a barrel, shown at 18 and 22 in FIG. 1, increases the efficiency of fan 12 by closely encircling and shrouding the blade tips of the fan. Support structure 16 houses electrodrive fan 30 which combines with fan 12 to pull air through radiator 14.

Figure 2:
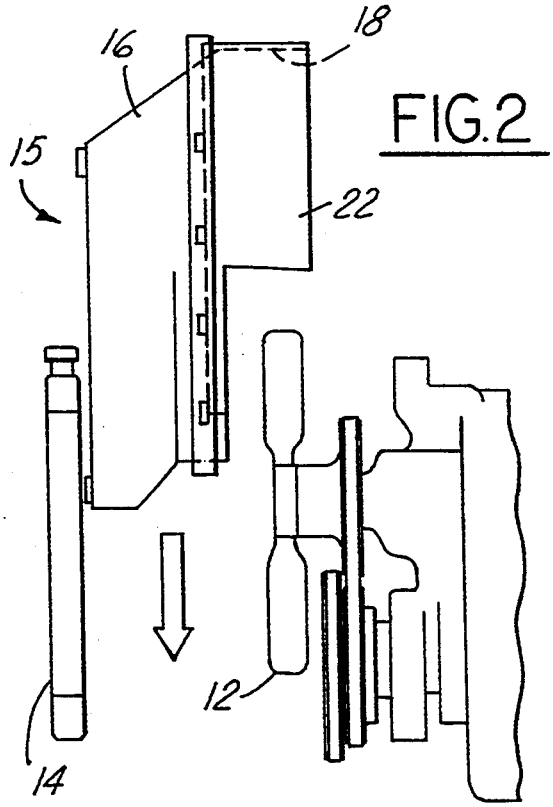
FIG. 2 is a side elevation illustrating a fan duct according to the present invention being moved into proximity to an engine driven cooling fan while in an open, shipping position.
Figure 3:
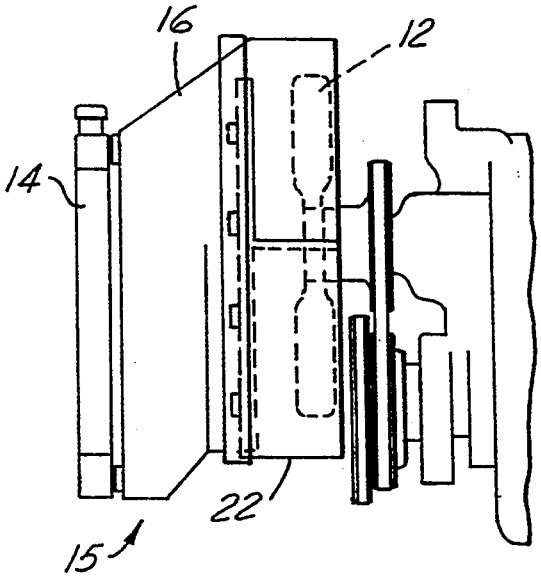
FIG. 3 shows the fan shroud of FIG. 2 in the closed, or installed, position.

FIG. 2 illustrates fan duct 15 in its first, or shipping, position in which movable barrel segment 22 is nested upon fixed barrel segment 18. Fixed barrel segment 18 comprises only about half of the complete barrel assembly, and as a result, when movable barrel segment 22 is nested upon fixed segment 18, duct 15 may be moved into proximity of fan 12 by moving radially with respect to fan 12, as shown by the direction of the arrow in FIG. 2, until registry is achieved with fan 12 and radiator 14, as shown in FIG. 3. Those skilled in the art will appreciate in view of this disclosure that a fan duct according to the present invention could be profitably employed with not only insertion systems working from on top of a vehicle but also underneath—in other words with the fan duct moving in the position from underneath the vehicle, or from either side for that matter, because the variable geometry of a fan duct according to the present invention is compatible with insertion of the fan duct from any direction. As seen from the various figures, movable barrel segment 22 has an inside diameter which is sized to fit the outside diameter of fixed barrel segment 18.

FIGS. 4, 5, and 6 illustrate various aspects of the retention and track mechanism which allow movable barrel segment 22 to rotate from its nested to its installed position upon fixed barrel segment 18. As shown in FIG. 4, fixed barrel segment 18 has a mating slot 24 formed about its entire periphery. This mating slot is engaged by U-shaped flange 26 which is formed on the leading edge of movable barrel segment 22 (FIG. 6). As further shown in FIG. 6, flange 26 is combined with a plurality of tabs 28 (see also FIGS. 4 and 5), which serve to allow movable barrel segment 22 to provide variable geometry by rotating with respect to fixed barrel segment 18 as described herein, while preventing detachment of movable segment 22 from fixed segment 18.

Use of an air duct according to the present invention will provide cost savings during the manufacturing of vehicles or other engine-powered equipment because the movable barrel segment may be rotated manually and secured in the installed position without the use of tools.

While the invention has been shown and described in its preferred embodiments, it will be clear to those skilled in the arts to which it pertains that many changes and modifications may be made thereto without departing from the scope of the following claims.

We claim:

1. A variable geometry fan duct for an automotive engine cooling system having a fan-cooled, liquid-to-air radiator, said duct comprising:

a support structure for securing said fan duct to the radiator;

a fixed barrel segment, attached to said support structure, for partially encircling an axial-flow cooling fan, with said barrel segment extending axially from said support structure such that the barrel segment shrouds the blade tips of a fan which is mounted so as to draw cooling air through said duct and the radiator; and a movable barrel segment attached to said fixed segment, with said movable segment being rotatable from a first position in which it is nested with said fixed segment, to a second position in which said segments completely encircle and shroud the blade tips.

2. A fan duct according to claim 1, wherein the movable barrel segment comprises a partial cylinder having a flange engaged with a mating slot formed on said support structure such that said flange may slide within the slot as the movable barrel segment rotates with respect to the fixed barrel segment.

3. A cooling system for an automotive internal combustion engine, comprising:

a liquid-to-air radiator;

an engine driven fan for moving air through the radiator; and a variable geometry fan duct comprising:

a support structure for securing said fan duct to the radiator;

a fixed barrel segment, attached to said support structure, for partially encircling said cooling fan, with said barrel segment extending axially from said support structure such that the barrel segment shrouds the blade tips of the fan; and a movable barrel segment attached to said fixed segment, with said movable segment being rotatable from a first, or shipping, position in which it is nested upon said fixed segment, to a second, or installed, position in which said segments completely encircle and shroud the blade tips.

4. A cooling system according to claim 3, wherein the movable barrel segment comprises a partial cylinder having a flange engaged with a mating slot formed on said support structure such that said flange may slide within the slot as the movable barrel segment rotates with respect to the fixed barrel segment.

5. An cooling system according to claim 3, further comprising an electrodrive fan mounted within said support structure so as to assist said engine driven fan in pulling air through said radiator.

6. A method for installing a variable geometry radiator fan duct in a vehicle having an internal combustion engine and an engine driven fan for moving air through a liquid-to-air engine cooling radiator, comprising the steps of:

placing the fan duct in an open configuration suitable for moving the duct into a position partially encircling the fan;

installing the duct to a radiator while it is in the open configuration; and placing the duct into a closed configuration in which the duct forms a barrel by manually rotating a movable barrel segment with respect to a fixed barrel segment until the segments form a complete ring around the fan blades.

* * * * *